US005971164A

United States Patent [19]

Wong

[11] Patent Number: 5,971,164

[45] Date of Patent: Oct. 26, 1999

[54] COLLAPSIBLE AND EXTENDABLE MODULAR CD CASE

[75] Inventor: M. S. Wong, Taipei, Taiwan

[73] Assignee: CMC Magnetics Corporation, Taipei, Taiwan

[21] Appl. No.: 08/927,541

[22] Filed: Sep. 11, 1997

[51] Int. Cl.[6] ..... A47F 7/00

[52] U.S. Cl. ..... 211/40

[58] Field of Search ..... 211/40, 41.12, 211/195, 194; 312/9.54, 9.9; 206/387.15; D6/407

[56] References Cited

U.S. PATENT DOCUMENTS

| | | | |
|---|---|---|---|
| 1,049,726 | 1/1913 | Johnson | 211/195 |
| 1,714,629 | 3/1929 | Rodin | 211/195 |
| 4,535,896 | 8/1985 | Evenson | 211/195 |
| 5,086,932 | 2/1992 | Gelardi et al. | 211/40 |

*Primary Examiner*—Alvin Chin-Shue
*Assistant Examiner*—Sarah Purol
*Attorney, Agent, or Firm*—Bacon & Thomas

[57] ABSTRACT

Disclosed is a collapsible and extendable modular CD case of which each module forming the CD case includes a base member and two side members all having a plurality of parallel partitions on their inner surfaces to provide many open compartments for each receiving a CD therein. The base member has joint arms projecting from four corners and complementary engaging means formed on a front and a rear edge. Each of the joint arms is provided on an inner surface at predetermined positions with a pivotal hole and a retaining hole to respectively receive a stud and a retaining boss correspondingly formed on an outer end surface of each side member, so that each side member is pivotally connected to and between two of the joint arms at the same side of the base member by engagement of the pivotal holes with the studs. The side member each has a length about one half of the base member, so that the side members can be pivotally turned downward to completely lie flat on the base member when the modular CD case is not in use. And, the modular CD case is extendable by freely connecting it to a further module by associating the engaging means on the modular CD case with the complementary engaging means on the further module.

3 Claims, 5 Drawing Sheets

COLLAPSIBLE AND EXTENDABLE MODULAR CD CASE

BACKGROUND OF THE INVENTION

The present invention relates to an improved CD case, and more particularly to a modular CD case which can be collapsed to occupy as small room as possible when it is not in use, or be extended in length to provide more room for CDs.

Since CDs can store large quantity of information in the form of digital data, they are widely employed in musical production to replace the old fashion records and in many other fields for convenient storage and access of various kinds of information products and 'software. Following the increasing growth in the quantity of CDs used in our daily life, various types of CD cases, racks, and other storage structures are developed and available in the market. Most conventional CD racks or storages include a support with a plurality of parallel compartments for each accommodating one single piece of CD therein. These conventional CD racks or storages usually have a fixed volume and are not collapsible, and therefore occupy considerable space when they are not in use or are to be moved. Some of these CD racks or storages are so designed that they have an appearance matching with other furniture. Under this condition, the CD racks or storages are largely limited in their functions of displaying and storing CDs without the possibility of freely changing or expanding the storing capacity thereof. There are also many knockdown CD racks available in the market to provide different appearances, functions, and effectiveness. Other types of CD racks are developed and introduced to the market, but all of them have some kinds of disadvantages and need improvements.

SUMMARY OF THE INVENTION

A primary object of the present invention is to provide a modular CD case which can be collapsed to occupy a minimum storage space when the CD case is not in use, and which can also be freely extended to increase the CD storage space as necessary.

Another object of the present invention is to provide a freely extendable modular CD case which can be easily assembled from more than one modules which are firmly connected to one another through specially designed complementary engaging means.

To achieve the above and other objects, the modular CD case according to the present invention includes at least one module which mainly includes a base member and two side members all having a plurality of parallel partitions on their inner surfaces to provide many open compartments for each receiving a CD therein. The base member has joint arms projecting from four corners and complementary engaging means formed on a front and a rear edge. Each of the joint arms is provided on an inner surface at predetermined positions with a pivotal hole and a retaining hole to respectively receive a stud and a retaining boss correspondingly formed on an outer end surface of each side member, so that each side member is pivotally connected to and between two of the joint arms at the same side of the base member. The side member each has a length about one half of the base member, so that the side members can be pivotally turned downward to completely lie flat on the base member to allow the modular CD case to occupy a minimum space when it is not in use. And, the modular CD case is extendable by freely connecting it to a further module by associating the engaging means on the modular CD case with the complementary engaging means on the further module.

BRIEF DESCRIPTION OF THE DRAWINGS

The structure and features of the present invention can be best understood by referring to the following detailed description of the preferred embodiment and the accompanying drawings, wherein.

DETAILED DESCRIPTION OF THE PREFERRED EMBODIMENT

Figure 1:
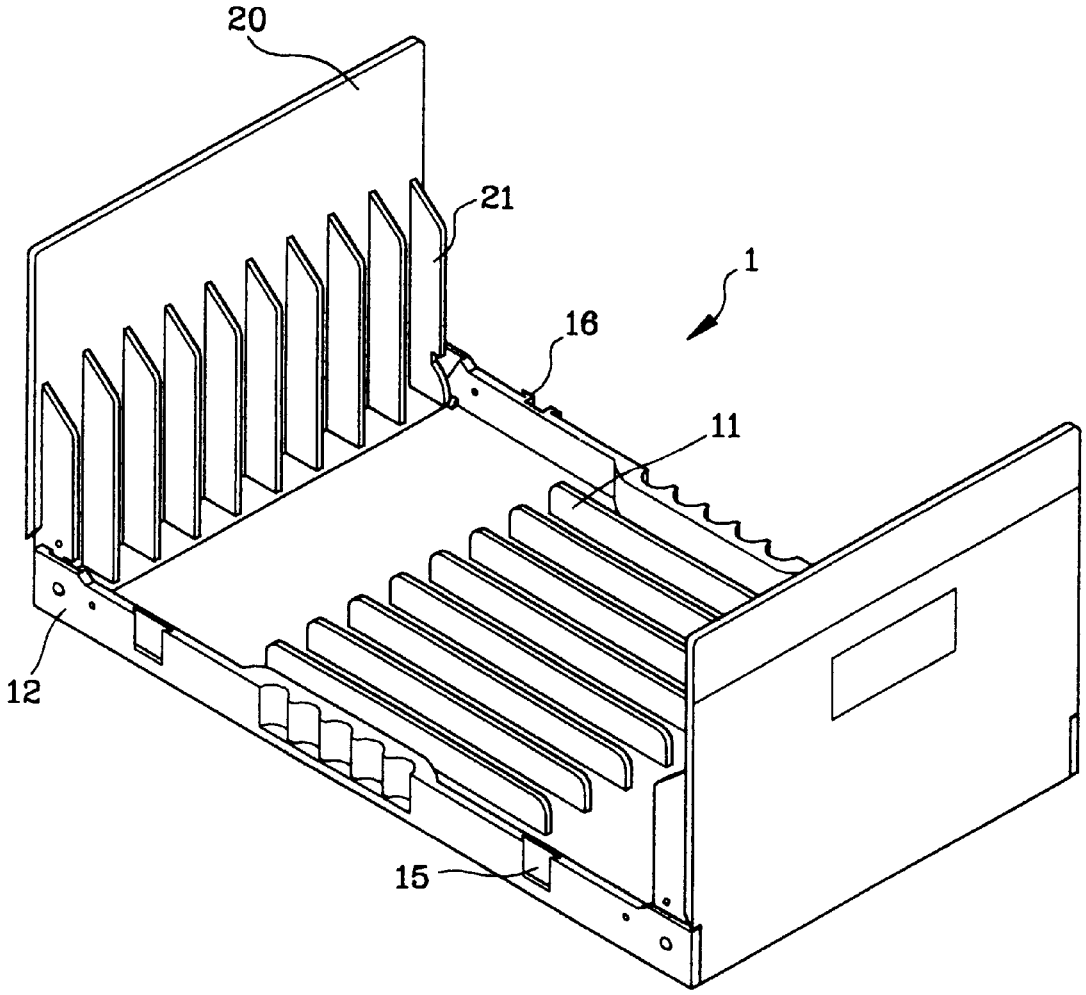
FIG. 1 is a perspective showing a module of the CD case according to the present invention in an assembled state.
Figure 2:
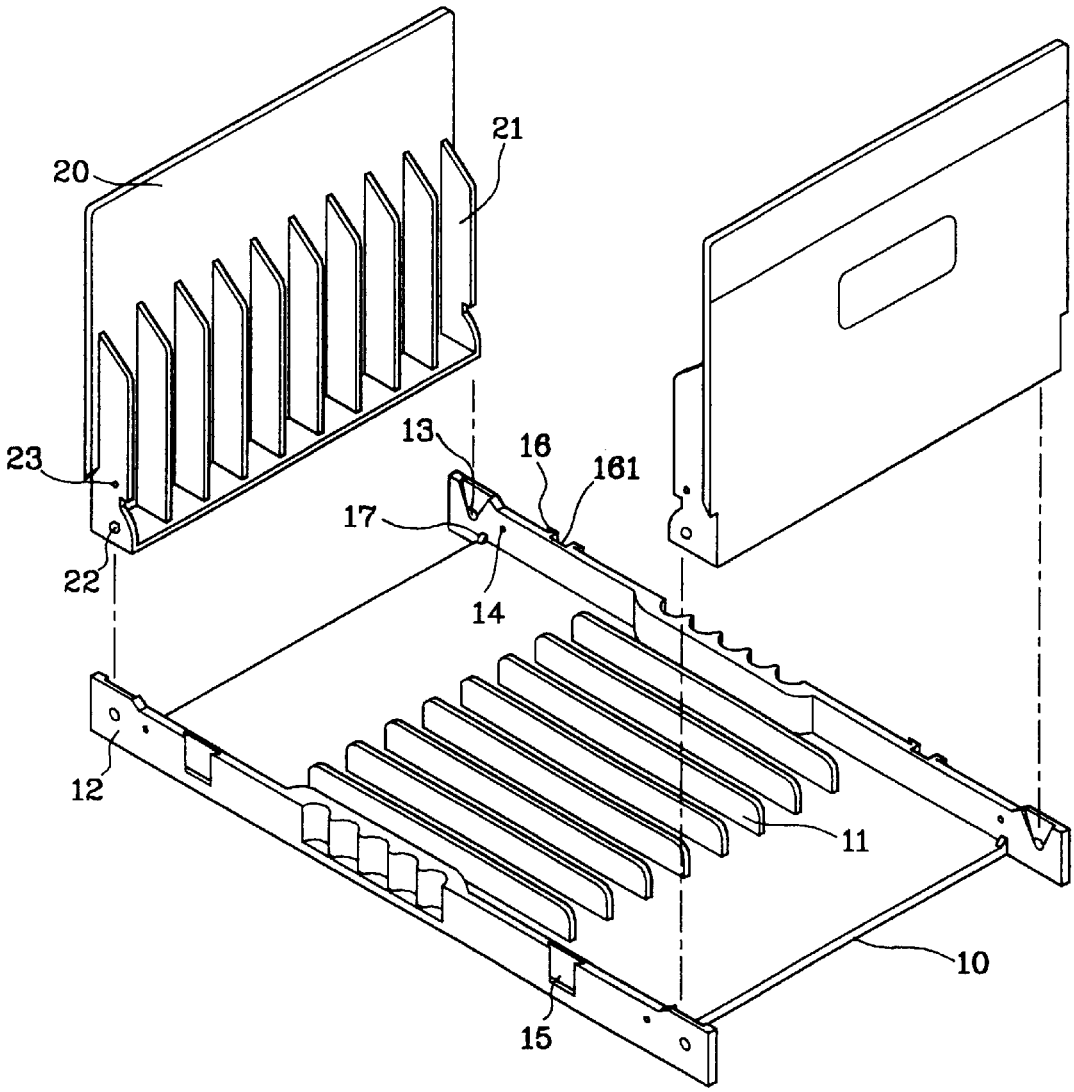
FIG. 2 is an exploded perspective of the CD case module of FIG. 1.

The present invention relates to a modular CD case. FIGS. 1 and 2 respectively illustrate an assembled and an exploded perspective of a module 1 forming a basic unit of the CD case according to the present invention. As shown, the module 1 each includes a base member 10 and two symmetrical side members 20 connected to two sides of the base member 10.

The base member 10 has a substantially U-shaped cross section and a plurality of first parallel partitions 11 transversely extending across a central portion of an inner top surface of the base member 10. From two ends of each side of the base member 10, two joint arms 12 laterally extend from the base member 10. A stopper 17 is provided on the base member 10 at each joint of the arm 12 and the base member 10. A guiding recess with a pivotal hole 13 therein and a retaining hole 14 are separately formed on each joint arm 12 at predetermined positions. Two dovetail-shaped recesses 15 are formed on an outer surface of a front wall of the base member 10 and two dovetail-shaped projections 16 are correspondingly formed on an outer surface of a rear wall of the base member 10. Each dovetail-shaped recess 15 and a corresponding dovetail-shaped projection 16 together form a pair of complementary engaging means. As can be particularly seen from FIG. 4, the dovetail-shaped projection 16 has a middle opening 161, making two sides of the dovetail-shaped projection 16 somewhat resilient and therefore suitable for engaging into and being retained to the dovetail-shaped recess 15.

Both the two side members 20 have an L-shaped cross section. Since the side members 20 are symmetrically formed, only one of them is described herein. Each side member 20 has a length about one half of that of the base member 10. A plurality of second parallel partitions 21 are formed on an inner surface of the side member 20 corresponding to the first parallel partitions 11. Each second parallel partition 21 transversely extends from an outer edge of the side member 20 adjacent to one side of the base member 10 toward an inner edge of the side member 20, such that a length of the second partition 21 is about a distance between the side of the base member 10 adjacent to the side member 20 and an end of a corresponding first partition 11 pointing toward that side of the base member 10. A stud 22 and a retaining boss 23 are provided at each outer end surface of the side member 20 corresponding to the pivotal hole 13 and the retaining hole 14, respectively, formed on each joint arm 12 of the base member 10.

To assemble the modular CD case 1, simply position the side member 20 between two joint arms 12 at the same side of the base member 10 and engage the studs 22 on the side member 20 with the pivotal holes 13 on the joint arms 12. With the guiding recesses, the side member 20 can be easily guided into the base member 10 to be pivotally connected thereto.

Figure 3:
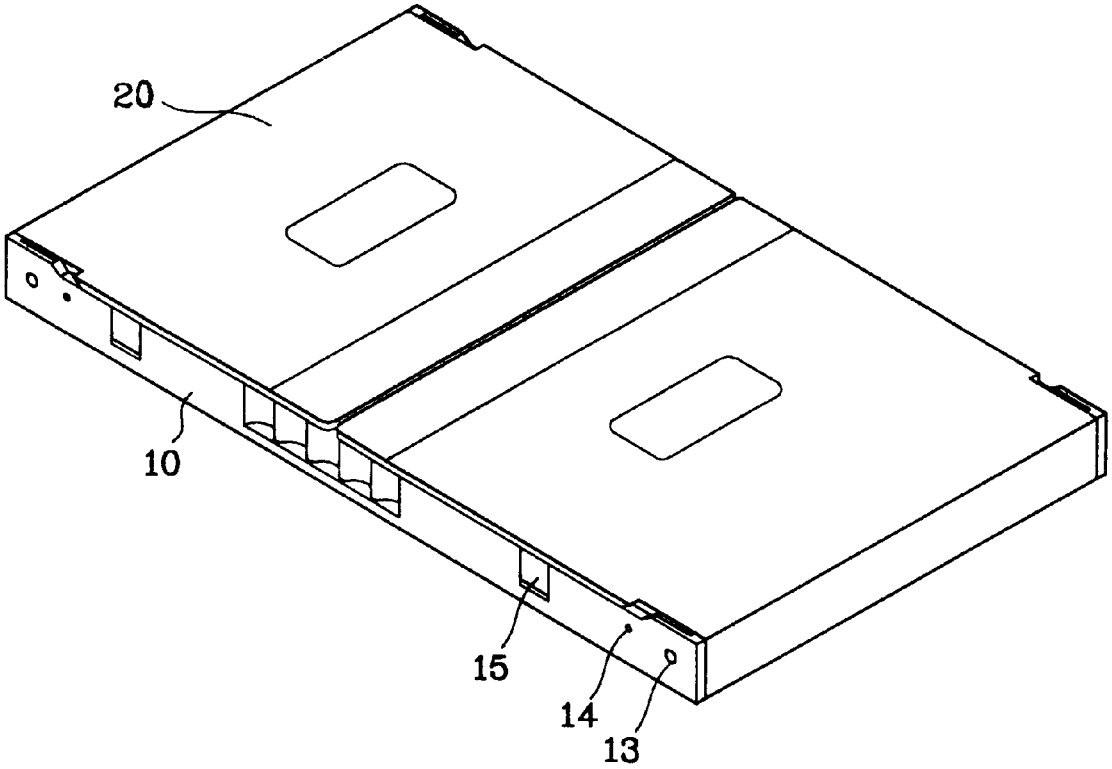
FIG. 3 illustrates the CD case module of FIG. 1 in a collapsed state.

As shown in FIGS. 1 and 3, when the CD case 1 according to the present invention is not in use, the two side members 20 can be pivotally turned downward to lie on the base member 10 with the retaining bosses 23 engaging into the retaining holes 14 and therefore preventing the side members 20 from easily turning upward again. When the modular CD case 1 is in a collapsed state, that is, in a state with the two side members 20 lying flat on the base member 10, it occupies only a very small room and is convenient for storage. On the other hand, when the two side members 20 are pivotally turned upward from the lying position to an upright position, they shall be stopped by the stoppers 17 provided on the base member 10 at the joints of the joint arms 12 and the base member 10 from moving outward any further. At this point, the first parallel partitions 11 at a central portion of the base member 10 and the second parallel partitions 21 on two side members 20 together provide a plurality of open compartments for each receiving a CD therein.

Figures 4A, 4B:
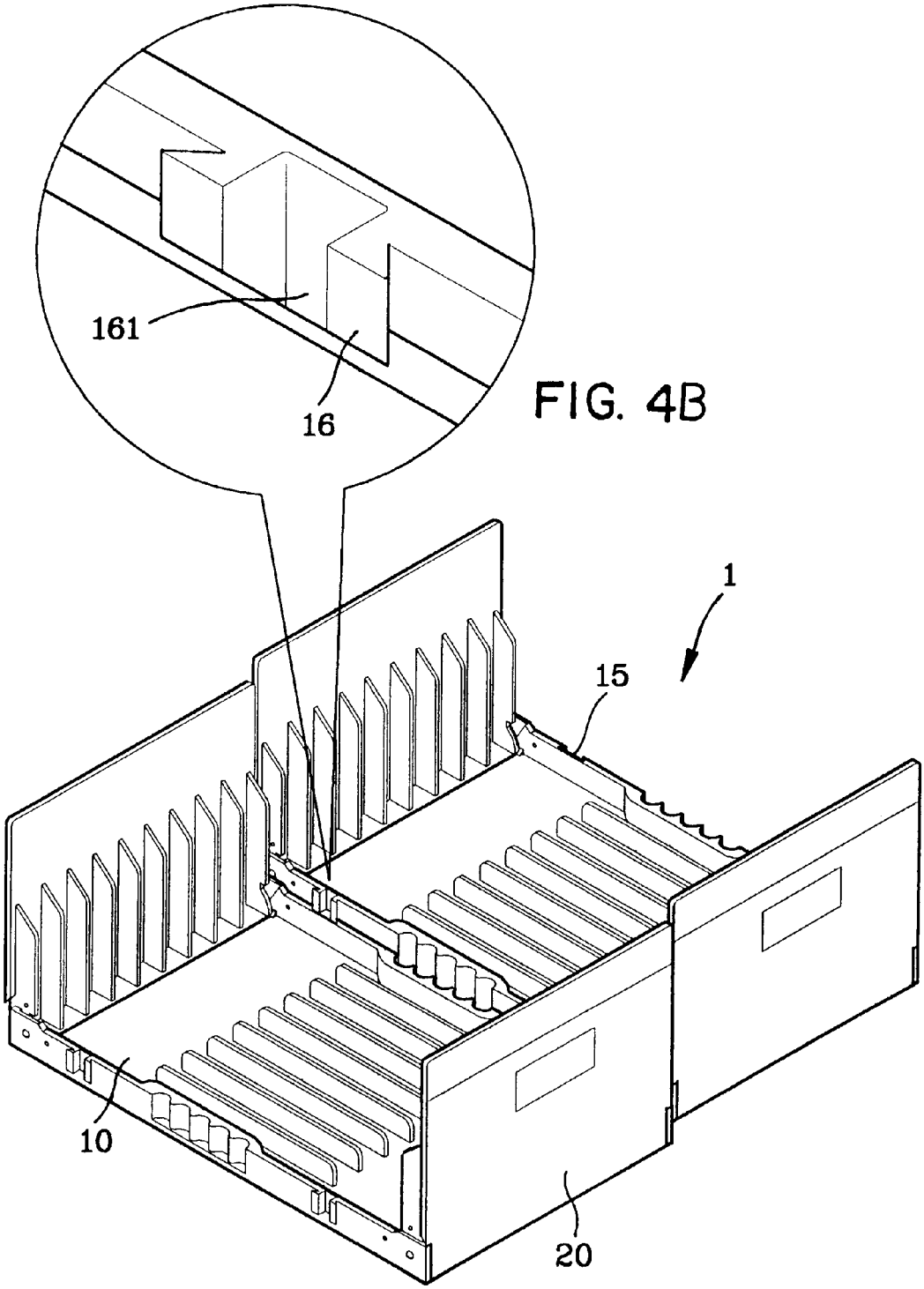
FIG. 4 illustrates the manner of extending the CD case of the present invention by connecting two modules of FIG. 1 together.
Figure 5:
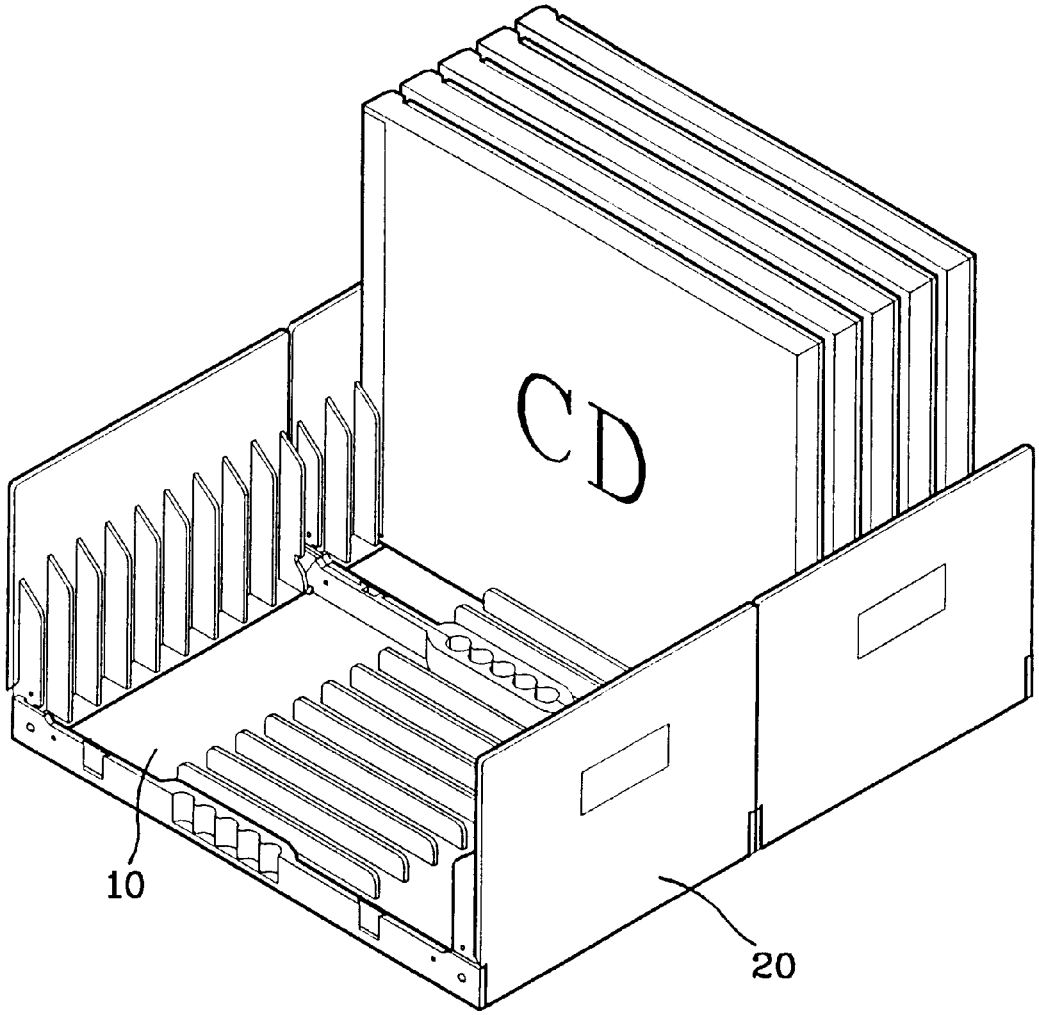
FIG. 5 shows the modular CD case of the present invention with some CDs positioned therein.

Please refer to FIGS. 4 and 5. The present invention is a modular CD case which can be freely extended by connecting additional modules to a first modular CD case 1 as necessary. To do so, simply align and engage two dovetail-shaped projections 16 of the additional modular CD case 1 with the two dovetail-shaped recesses 15 of the first modular CD case 1. The extended modular CD case 1 conveniently provides double or more spaces for CDs.

With the above arrangements, the present invention has a simple structure and is collapsible to save a lot of space needed for storage of the CD case when it is not in use. Moreover, more than one modular CD case can be easily connected to one another to quickly provide more space for CDs. The modular CD case according to the present invention is novel, convenient, and practical.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A modular CD case formed from at least one collapsible and extendable module, each said module forming said modular CD case comprising a base member and two side members, said base and said side members being provided on their inner surfaces with a plurality of parallel partitions to form open compartments in said modular CD case for each receiving a CD therein, said base member having a joint arm laterally projecting from each corner of said base member and a stopper provided at each joint of said joint arm and said base member, said base member also being provided at a front and a rear edge with complementary engaging means, each said joint arm being provided on an inner surface at predetermined positions with a pivotal hole and a retaining hole to respectively receive a stud and a retaining boss correspondingly formed on each outer end surface of each said side member, whereby each said side member is pivotally connected to and between two of said joint arms at one side of said base member by engagement of said pivotal holes with said studs, each said side member having a length about one half of a total length of said base member, so that said side members can be pivotally turned downward to completely lie flat on said base member to enable said CD case to occupy a minimum space when said CD case is not in use, and said modular CD case being extendable by freely connecting it to a further module by associating said engaging means on said modular CD case with said complementary engaging means on said further module.

2. A collapsible and extendable modular CD case as claimed in claim 1, wherein said parallel partitions on said base member transversely extend across only a central portion of said inner surface of said base member, and wherein said two side members have an L-shaped cross section and said parallel partitions on said side members extend from outer edges of said side members toward inner edges thereof to a length equal to a distance between one side of said base member and an end of each said parallel partition on said base member pointing to said one side.

3. A collapsible and extendable modular CD case as claimed in claim 1 or 2, wherein said base member has a U-shaped cross section and therefore includes a front and a rear wall at its front and rear edges, respectively, and wherein said complementary engaging means include at least two dovetail-shaped recesses provided at an outer surface of said front wall and at least two dovetail-shaped projections provided at an outer surface of said rear wall corresponding to said dovetail-shaped recesses, and said dovetail-shaped projections each having a middle opening to make two sides of said projections slightly resilient.

* * * * *